United States Patent [19]

Peter

[11] Patent Number: 4,534,451

[45] Date of Patent: Aug. 13, 1985

[54] INCLINED ELEVATOR WITH SINGLE RAIL

[75] Inventor: Karl Peter, Vorarlberg, Austria

[73] Assignee: ROMEX Aktiengesellschaft, Bendern, Liechtenstein

[21] Appl. No.: 497,762

[22] Filed: May 24, 1983

[30] Foreign Application Priority Data

May 26, 1982 [AT] Austria ..... 2066/82

[51] Int. Cl.[3] ..... B66B 9/06

[52] U.S. Cl. ..... 187/12; 187/67; 187/94; 188/279; 188/136

[58] Field of Search ..... 187/6, 12, 13, 14, 67, 187/94; 104/118, 119, 120, 280; 188/44, 166, 136, 129, 279

[56] References Cited

U.S. PATENT DOCUMENTS

| | | | |
|---|---|---|---|
| 1,838,204 | 12/1931 | Wood . | |
| 1,932,060 | 10/1933 | Arnold | 187/67 |
| 2,249,900 | 7/1941 | Honig | 187/12 |
| 3,088,545 | 5/1963 | Meyer | 187/6 |
| 3,472,342 | 10/1969 | Wuesthoff | 187/94 |
| 4,249,462 | 2/1981 | Guzzi | 98/36 |

FOREIGN PATENT DOCUMENTS

| | | | |
|---|---|---|---|
| 170128 | 1/1960 | Sweden | 104/120 |
| 1487828 | 10/1977 | United Kingdom . | |

*Primary Examiner*—H. Grant Skaggs
*Assistant Examiner*—Andrew Jones
*Attorney, Agent, or Firm*—Karl F. Ross; Herbert Dubno

[57] ABSTRACT

The invention relates to an elevator, especially an inclined elevator, with a rigid runway on single poles, a load transportable between stations, a motor-driven traction element and if necessary a counterweight. It consists in principle of a single rail (1) used as a runway, said rail being a hollow-tube profile, preferably having a square profile, whose diagonal is in vertical position and in that inside the rail (1) if necessary the counterweight (8) is guided, that the load (11) to be moved and if necessary also the counterweight (8) are suspended on a circular steel chain (5) which is turned by approximately 180° around a sprocket (6) connected to a drive (7).

5 Claims, 7 Drawing Figures

INCLINED ELEVATOR WITH SINGLE RAIL

FIELD OF THE INVENTION

The invention relates to an elevator, especially an inclined elevator with a rigid runway on single poles, a load transportable between stations, a motot-driven traction element and a counterweight.

BACKGROUND OF THE INVENTION

Inclined elevators built up to now have at least two rails which must run exactly parallel to each other and for this reason are mounted as a rule on ties, lying on prepared gravel beds, in flattened terrain or on continuous bridge structures.

Moreover, known inclined elevators are moved mostly via steel cables, which can be turned and driven only by large-diameter pulleys; therefore the counterloads or balancing loads are usually formed as second vehicles and require either a divided runway or complicated switches.

In order to achieve a friction contact between the hoisting cable and the drive wheel, as required for the drive in known installations, in the case of steep terrain driven pulleys are required, also very expensive constructions for the drive, and the foundations and powerhouses required for these drives. Other drive systems are built as cable winches, whereby a traction cable is wound by means of a motor on likewise very large machines. Previously, inclined elevators have been built with water in a counterweight.

A circular steel chain is used with good results as a traction element in elevators of all types, whereby the chains running from the drive is either free hanging or remains suspended several times or is stored in a chain case.

OBJECT OF THE INVENTION

The object of the invention is to solve the problems related to opening an area of new development of smaller proportions in an economical and inconspicuous way and in the shortest time, when traditional systems are not suitable, i.e. to provide an improved inclined-rail elevator.

SUMMARY OF THE INVENTION

This is achieved in the case of an elevator of the aforedescribed type, in which a single rail is provided as a runway, the rail being a hollow-tube profile, preferably with a square profile whose diagonal is positioned vertically, a counterweight is guided inside the rail when necessary and the load to be moved and also the counterweight are suspended on a circular steel chain, which passes around a sprocket connected with a drive by approximately 180°. It is advantageous when the circular steel chain passes around by approximately 180° and stretched at the drive end as well as the opposite runway end, whereby the chain is built as a revolving chain and is guided over a portion of its length inside the rail.

The equipment according to the invention can be rapidly and economically mounted everywhere by assembling it from prefabricated modules, where for instance one has to break ground or to overcome a steep ground section; also for opening areas of development for contruction or residential purposes and in the case of deep-level building obstacles as elevator between the floors and also to the open ground above or below the floors.

The installation is independent of inclination. This way primarily ground sections situated above or below public traffic bearers (street, railway, ship, etc) are made accessible or opened up, settlements or tourist facilities and hotels are connected to low-lying beaches or parts of a town are connected to each other.

The installation according to the invention can also run on the outside along the walls of hospitals for evacuating bedridden patients in case of a catastrophic fire; said installation can also be used as emergency and escape facilities for instance in inner yards of high-rises or on any of their outer walls.

With only one single railway the installation according to the invention is mounted on industrial foundations located for apart. The foundations can be made of precast concrete and set into the ground.

This railway includes a vehicle which is suspended on the chain. The driving means consists preferably of a hydraulic motor and is directly flanged to the head of the rail, together with the brake.

Since the driving sprocket for the chain can have a very small diameter, it is possible to arrange the sprocket between the two approximately parallel chain stringers, which lead to the vehicle and to the balancing weight. Even in the case of very steep installations, the engagement of the transporting chain is frictionally connected. The small sprocket also saves transmissions or exposed ring gears. The drive-sprocket can be arranged either directly on the driving shaft of the hydromotor or on the driving shaft of a single-step worm-gear-motor.

This single-rail inclined elevator is particularly safe for traffic due to the selected arrangements according to the invention. Not only does the rail always run above the ground, whereby it is particularly easy to keep the runway free of snow, but also the possibility exists, in the case of snowfalls or ice, to introduce slightly warmed air into the hollow space of the rail, which keeps the rail snow-and ice free. Due to the inclined walls the rain flows away immediately and the snow finds no support.

A particular embodiment is characterized in that the chaim after being passed around by the drive sprocket, when used without a counterweight, is lead for storage in a chain case.

In the case of a path of lower inclination, instead of the balancing weight a counterchain (tensioning chain) is used and is guided over a return sprocket at the other end of the rail back to the mechanism of the vehicle. Thereby the drive can be mounted at either end of the rail. For instance, this way river crossings and the like are possible.

On the upper edge of the hollow rail a glide profile made of synthetic material is mounted, in which the chain slides and is protected against against winds. A similar profile is situated inside the hollow rail to receive the reverse stringer. These profiles are made of vibration-and weather-resistant, abrasion-proof synthetic material.

A preferred embodiment is characterized in that the counterweight is bevelled at its downstream end, that the rail is closed downstream and the inside of the rail is filled downstream with a liquid, especially an antifreeze emulsion and that preferably the outer surface of the counterweight opposed to the beveling of the counterweight is provided with brake linings. It is further advisable to have brake-shoes positioned to face at least two diagonally located profile edges of the rail, said break-shoes being mounted on V-shaped supports overlapping the edges, said supports forming a portion of a line quadrilateral bellcrank, which is spring-loaded in the direction of the rail and lockable in a position retired from the rail by means of a latch, which can be mechanically or hydraulically expelled. By immersion of the accelerated balancing weight in this liquid a damping results due to the displacement of the liquid similar to a hydraulic brake, whereby the kinetic energy is dissipation and transformed into heat. In the case of a corresponding inclination, the end of the balancing weight forms an angle with respect to the horizontal plan of the liquid, so that no shock occurs when the displacement is initiated. This effect is further improved by a proper beveling of the lower part of the balancing weight. At the same time the balancing weight is deflected in the direction opposite to the beveling. By positioning the brake linings on the sides opposite to the beveling the dissipation of kinetic energy is effectively assisted.

A source of danger for the operation can originate in unforeseeable blockings in the run of the counterweight. To this effect, besides an electrical or electronical safety device, a safety device for the chain is mounted at the exit from the driven sprocket, whereby a chain case for receiving the reverse chain is useful. When the mechanism is stopped, for instance in emergency braking, the drive is also stopped so that in the vehicle stringer of the chain a blocking of the chain is avoided. For cases of reduced pretension it is also possible to mount an indicator for chain slackness.

By renouncing the advantages of a balancing weight the transporting chain can also be guided from the drive sprocket into a chain case.

BRIEF DESCRIPTION OF THE DRAWING

Further features of the invention are described with the aid of the drawing in which an embodiment of the object of the invention is represented schematically. In the Drawing.

SPECIFIC DESCRIPTION

Figure 1:
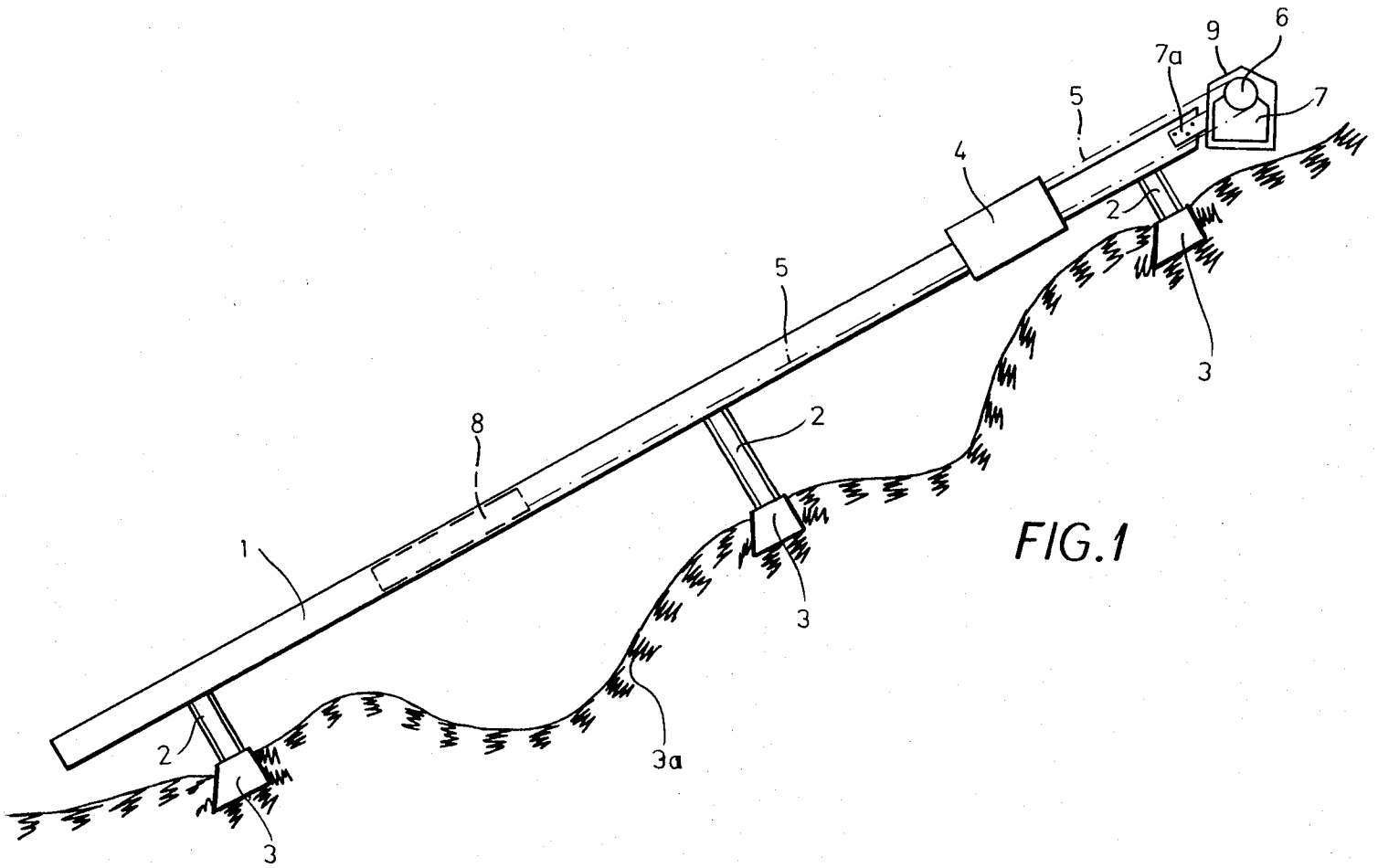
FIG. 1 shows in elevation a view of an installation without stop stations.

The hollow rail 1 is mounted on poles 2 in foundations 3 in the ground 3*a*. and carries a vehicle 4 which is suspended on the transporting chain 5 which in turn is rotated over a drive sprocket 6 at the drive 7 and guided to the counterweight 8 in the hollow rail 1. A protection hood 9 serves to shield the drive from atmospheric conditions and impact. The drive unit 7 is mounted on the hollow rail 1 with splices 7*a*.

Figure 2:
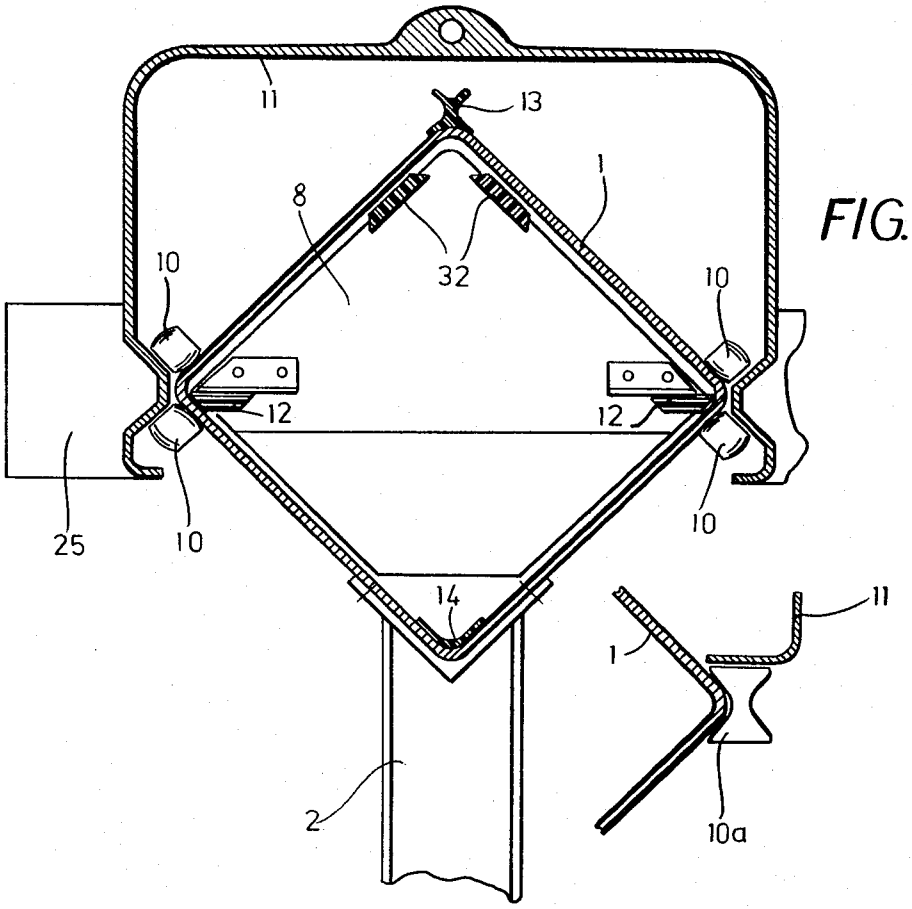
FIG. 2 is a cross-section of the hollow rail with mounted mechanism, though without seats or cabin, with built-in balancing weight and chain guides.
Figure 5:
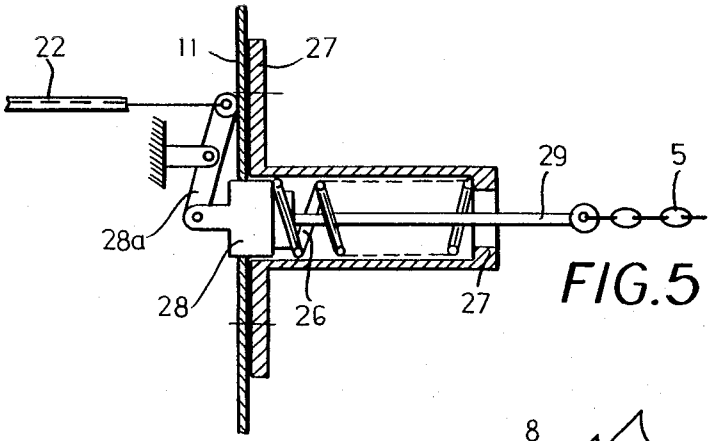
FIG. 5 is the element connecting the transporting chain to the vehicle with brake release in case of a chain break, shown in section.

The hollow rail, 1 in FIG. 2 represented in section carries the rollers 10 or 10*a* mounted in such a way as to sustain vertical as well as rotational forces on the rail. The rollers 10 or 10*a* are mounted in the chassis box 11 of the vehicle mechanism. This chassis box 11 carries in addition the rail brake and although not represented a structure with seats, a cabin or a load-carrying device. On the top end of the chassis box 11 the transporting chain is connected with the brake release element as shown in FIG. 5. Furthermore, in FIG. 2 the arrangement of the balancing weight 8 in the hollow rail 1 its roller bearing 12 and the glide profile of synthetic material 13 on the rail and 14 in the rail are represented. The reference numeral 32 indicates the emergency brake linings on the balancing weight 8. The rail rests on poles 2.

Figure 3:
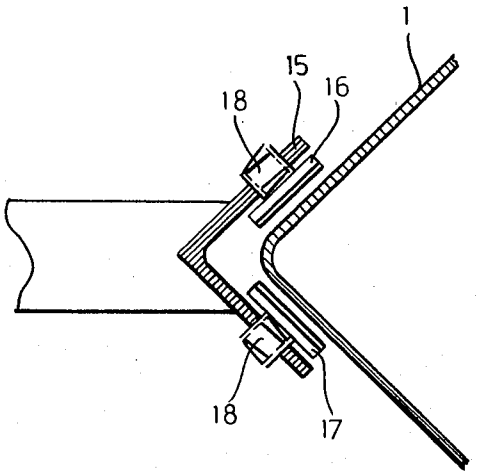
FIG. 3 is a view of the rail brake in section, but represented only on one side.

In FIG. 3 the same section of the hollow rail with lateral brake on one side is represented, whereby 15 indicates the brake-shoe support with the upper brake-shoe 16 and the lower brake-shoe 17, with the brake pressure regulators with spring 18.

Figure 4:
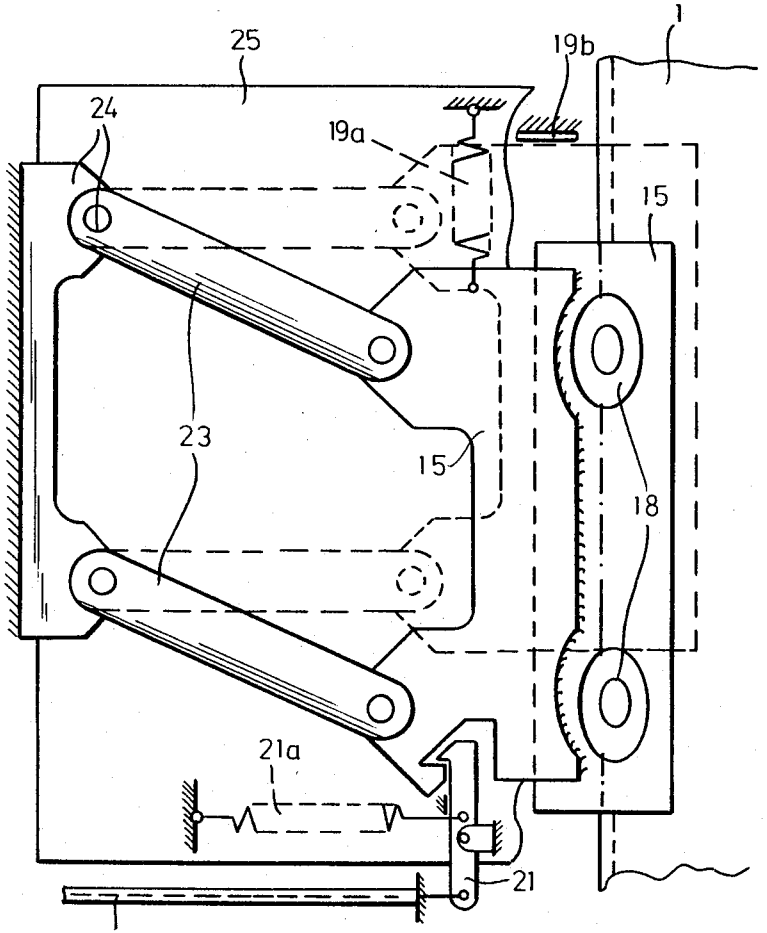
FIG. 4 is a top view of a rail brake arranged laterally.

In FIG. 4 the rail brake is shown in top view. The brake control arms 23 (forming a link quadrilateral bellcrank) with mounting 24 in the brake box 25 are deflected in the rest position. In the deflected "ready" position the brake-shoe support 15 engages in a latch 21. The latch 21 is secured by a spring 21*a*. The brake-shoe support 15 is prestressed by means of a spring 19*a*. By releasing the latch 21 via an element 22 the brake unit is pressed against the rail 1 by the prestressed spring 19*a* and is directed through braking friction under friction contact to the stop 19*b*. Thereby the brake-shoes spring back in the brake pressure regulator 18 and this way a desirable delay is kept within strict limits. The braking device arranged symmetrically on both sides is shown only on one side. With a simple traction device, the brakes are brought back into the operation position after their loosening by a motion reversal whereby they lock. The latch 21 or a corresponding element can, in the case of an emergency braking, be released manually by means of a device operating in parallel to the device 22 and thereby inducing the braking. The braking position is represented in dotted lines. The braking can also be induced by electrical signals.

In FIG. 5 the connection of the transporting chain 5 to the chassis 11 of the mechanism is represented schematically. A compression spring 26 in a housing 27, the traction support 28 and the traction rod 29 are fastened to the chassis 11. The conveying chain 5 is atriculated to the traction rod 29. Through the weight of the car on the inclined track the spring 26 is compressed and thereby the Bowden control cable 22 is released over a force-direction reverser 28*a* so that the released latch 21 in FIG. 4 can hold the brake in opened position.

Figure 6:
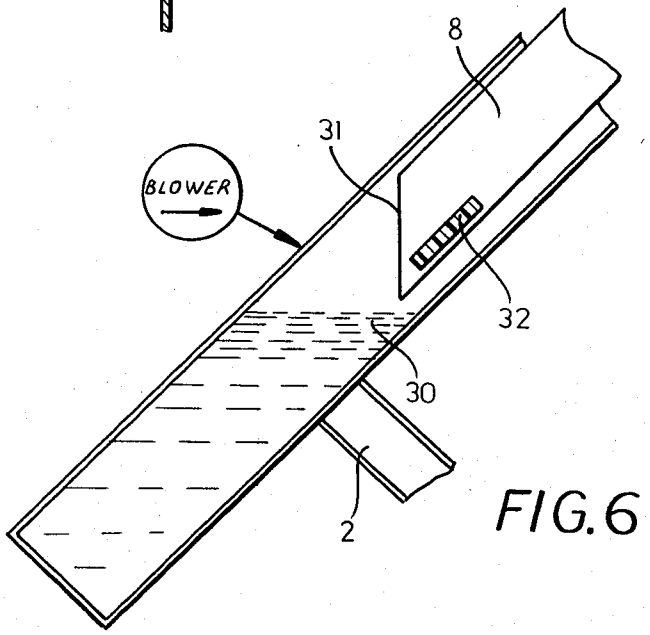
FIG. 6 is a lateral view of the damping of the balancing weight in case of unacceptable accelerations and FIG. 7 is a diagram of the rail braking system.

FIG. 6 shows a section of the lower end of the hollow railway 1 with a liquid filling 30, the balancing weight beveling 31 at the balancing weight 8 and brake linings 32 on the side of the balancing weight opposite the belveling.

Figure 7:
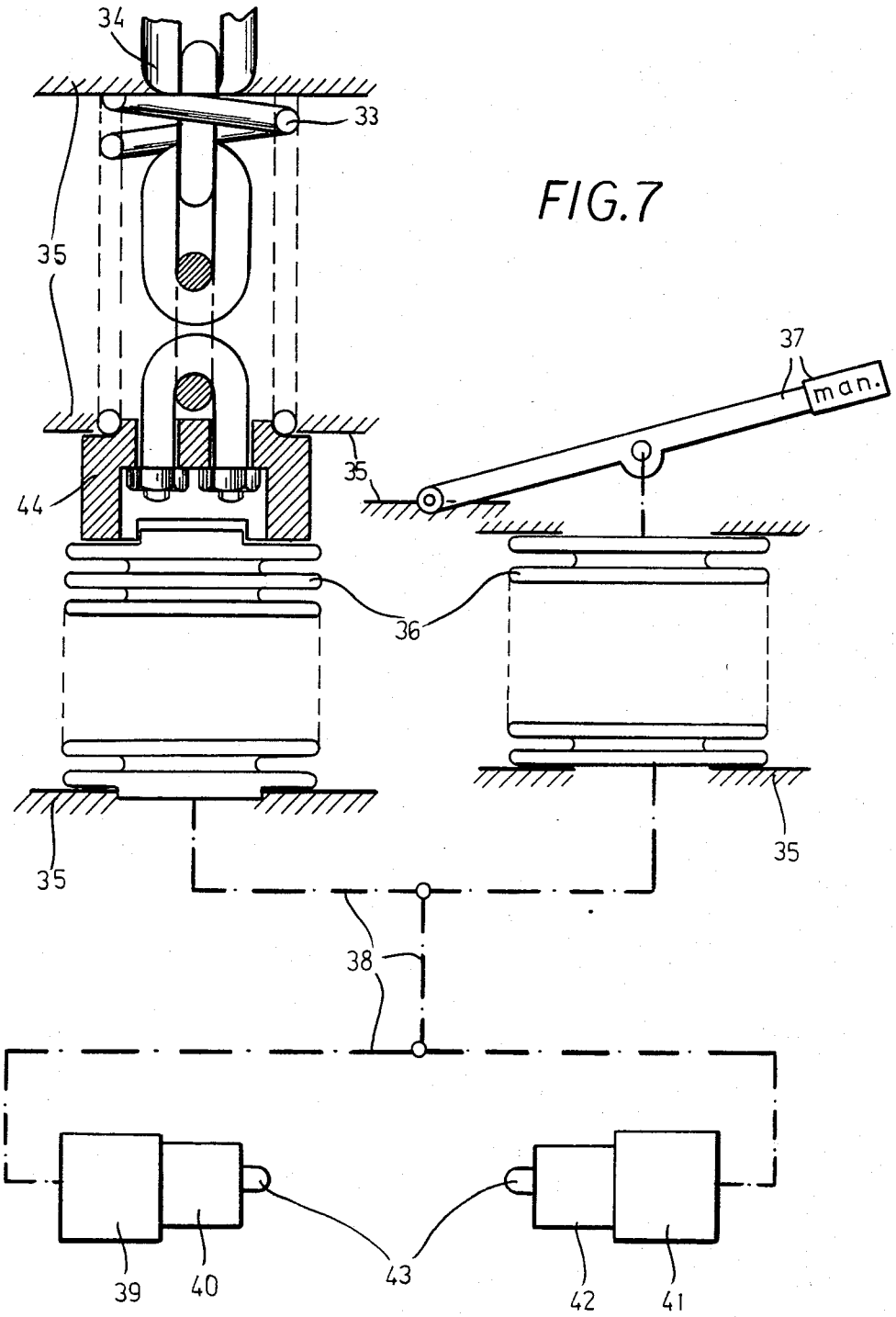

FIG. 7 shows the completely closed hydraulic brake-release system of the rail. Instead of the Bowden control cables or countersupports a wire system 38 is connected with spring bellows in a closed circuit. The spring bellows 36 are balanced during normal operation. The brake release system which comprises a spring bellow 39 and/or 41 and a retracting spring 40 and/or 42 with a release stem 43 is displaced hydraulically by the spring 40/42 and directed into the spring bellow 36, whereby said bellows take their original manufacturing dimension or are slightly opened. The transporting chain 34 while driven presses together a release spring 33 to a firm stop 35. When the chain 34 breaks, the spring 33 immediately presses together the spring bellow, displaces hydraulically and acts upon the spring bellows 39/41 (schematically represented), whereby the stem 43 is expelled, which releases the compression springs so that the braking is induced. A further spring bellow 36 is mounted in the vehicle for manual release by passengers. When this pressed together via a lever 37 the same function is carried out as in the case of a chain break. Firm stops 35 mutually prevent a further release of the bellows 36 so that the hydraulics are directed forcibly towards the brake release units.

A ram 44 transmits in case of chaim break the spring force of the spring 33 to the spring bellow 36.

When manually released it is also possible to mount a prestressed spring over the spring bellow, similar to the arrangement on the transporting chain which is held in a prestressed position by a breaking pin. Similar to the emergency brakes in railroad cars, in order to achieve the braking only a handle has to be pulled. This arrangement has the advantage of always balanced forces acting in the system. Since there are no pistons or the like, there can not be any oil leaks, therefore the system needs no supervision and has a high degree of operational readiness and safety.

I claim:

1. An elevator adapted to extend between stations, particularly an inclined elevator, having a rigid runway on single poles, a load transportable between said stations, a motor-driven traction element and a counterweight, characterized by the improvement wherein a single rail is provided as runway, said rail being shaped as a hollow-tube profile whose diagonal is in vertical position, the counterweight is guided inside the rail, the load to be moved and also the counterweight are suspended on a circular steel chain which passes by approximately 180° around a sprocket connected with the drive, brake-shoes are positioned opposite to at least two diagonally located profile edges of the rail, said brake-shoes being mounted on V-shaped supports overlapping the edges, said supports forming a portion of a link quadrilateral bellcrank which is spring-loaded in the direction of the rail and lockable in a position retracted from the rail by means of a latch which can be pushed out mechanically or hydraulically.

2. An elevator comprising:

a single rail inclined between a low location and a high location and formed as a closed polygonal profile tube having a diagonal disposed vertically and a pair of downwardly and outwardly inclined surfaces joined at an apex of said rail;

a vehicle displaceable on said rail between said locations above said surfaces;

a chain affixed to said vehicle, passing around a sprocket at said upper location and extending downwardly into the through said tube;

a counterweight on a lower end of said chain in said tube, said counterweight having a bevel on a lower end thereof; and a body of liquid in at least a lower portion of said tube whereby said bevel upon said counterweight encountering said body of liquid causes the counterweight to be pressed against walls of said tube to brake descent of said counterweight.

3. The elevator defined in claim 2 wherein said counterweight is formed with brake linings on a side thereof opposite said bevel for braking engagement with said tube.

4. The elevator defined in claim 2, further comprising means for blowing heated air through the interior of said tube.

5. The elevator defined in claim 3, further comprising means for blowing heated air through the interior of said tube.

* * * * *